US009777490B2

(12) United States Patent
Hubbard

(10) Patent No.: US 9,777,490 B2
(45) Date of Patent: Oct. 3, 2017

(54) FALSEWORK HOOK AND FASTENER

(71) Applicant: Falsework & Shoring Designs, Inc., San Jose, CA (US)

(72) Inventor: William Eugene Hubbard, San Jose, CA (US)

( * ) Notice: Subject to any disclaimer, the term of this patent is extended or adjusted under 35 U.S.C. 154(b) by 0 days.

(21) Appl. No.: 14/967,211

(22) Filed: Dec. 11, 2015

(65) Prior Publication Data

US 2017/0167147 A1 Jun. 15, 2017

(51) Int. Cl.
*E04G 17/00* (2006.01)

(52) U.S. Cl.
CPC ..... *E04G 17/00* (2013.01)

(58) Field of Classification Search
CPC ..... E04G 17/00; F16M 13/02; F16M 13/022; B66C 1/666; Y10T 403/556; Y10T 24/3488
See application file for complete search history.

(56) References Cited

U.S. PATENT DOCUMENTS 2,411,678 A 11/1946 Cornella
3,286,419 A * 11/1966 Eriksson ..... E04C 5/08 24/372
3,606,704 A * 9/1971 Baumann ..... E04F 15/024 248/619
4,048,938 A * 9/1977 Patterson, III ..... B63B 25/004 114/75
4,261,149 A * 4/1981 Gustafson ..... E04B 1/34352 52/292
4,437,640 A 3/1984 Heinzle
5,024,037 A 6/1991 Ono
5,234,188 A 8/1993 McSwain
5,259,690 A 11/1993 Legge
5,524,854 A 6/1996 McSwain et al.
5,660,007 A * 8/1997 Hu ..... E04H 9/021 52/167.3
5,902,075 A 5/1999 Krings
5,988,318 A 11/1999 Krause
6,086,035 A * 7/2000 Trifilio ..... A47B 55/02 211/90.03
6,530,456 B1 3/2003 Wallther
6,634,615 B1 * 10/2003 Bick ..... H02B 1/54 248/499
6,976,336 B2 12/2005 Hartz
(Continued)

FOREIGN PATENT DOCUMENTS

CA WO-9325767 A1 * 12/1993 ..... E02D 27/42
CN 202101841 U * 1/2012
(Continued)

*Primary Examiner* — Jeanette E Chapman
(74) *Attorney, Agent, or Firm* — IDP Patent Services; Olav M. Underdal

(57) ABSTRACT

A falsework hook for use in falsework, scaffolding, and general construction, includes a holder portion, which can be a tube portion, including a tube aperture; and a hook portion; such that the tube aperture is configured to receive a continuous threaded rod or an elongated outer end of an eye bolt. Also disclosed is a falsework fastener, including first and second falsework hooks and a falsework connector, which can include one of a rod connector, which can be a continuous threaded rod, which can be straight, curved, or bent; and a cable connector, including threaded eye bolts, connected with a cable.

16 Claims, 9 Drawing Sheets

(56) References Cited

U.S. PATENT DOCUMENTS

| | | | | |
|---|---|---|---|---|
| 7,204,345 | B2 | 4/2007 | Grant | |
| 9,163,783 | B1 * | 10/2015 | McLaughlin | F16M 13/022 |
| 2003/0029122 | A1 * | 2/2003 | Ecker | A62B 35/0068 52/698 |
| 2010/0313516 | A1 * | 12/2010 | Kreller | E04G 11/48 52/693 |
| 2015/0152654 | A1 | 6/2015 | Yamane | |

FOREIGN PATENT DOCUMENTS

| | | | | | |
|---|---|---|---|---|---|
| CN | 204552781 | U | * | 8/2015 | |
| DE | 3931494 | A1 | * | 4/1991 | E04B 1/4135 |
| GB | 2138464 | A | * | 10/1984 | E04B 1/2612 |
| JP | 2015166528 | A | * | 9/2015 | |
| SU | 600235 | A2 | * | 3/1978 | |

* cited by examiner

Falsework Hook

Straight Falsework Fastener

Falsework Bent

Eyed Falsework Hook

Flexible Falsework Fastener

FALSEWORK HOOK AND FASTENER

CROSS-REFERENCE TO RELATED APPLICATIONS

N/A.

FIELD OF THE INVENTION

The present invention relates generally to the field of falsework for building structures, including reinforced concrete bridges.

BACKGROUND OF THE INVENTION

Falsework constitutes temporary structures that are used to support construction work in process before the construction is able to support its own load.

Current methods of restraining horizontal loads utilize lumber, steel cable, C-Clamps and other materials. All of the current methods are labor intensive.

In conventional devices and methods, lateral loading is stabilized with timber bracing, wire rope cable or steel bars. Timber braces are typically used in conjunction with wood posts. Bolts or nails are used for connecting wood. Cables are typically attached to shackles in a hole burned into a steel beam. Steel bars, usually reinforcing steel, are typically welded to steel pipe posts.

Currently, the internal bracing of falsework bents is achieved with steel cable, steel bars or timber. The cable requires special tools and fasteners for the cable. The labor must have knowledge of the tools functions and proper application. Steel bars require welding, which is time consuming and expensive.

Timber bracing requires nailed or bolted connections. Bolts require a drill and time to drill through the posts. Nail connections typically require more than ten nails per connection. This is time consuming and tires the laborers. Production rates decrease with the volume of work.

Longitudinal bracing of the falsework system currently employed require the same bracing as the internal bracing system, causing similar issues of high labor time and cost.

Bracing beams together to prevent compression flange failure is currently achieved with metal banding. This material requires protection from being cut by the edge of the stringer. It also requires special tools for installation. The tools require training in their operation.

Thus, all of the current methods are labor intensive and may need specialized tools and training for installation.

As such, considering the foregoing, it may be appreciated that there continues to be a need for novel and improved devices and methods for use of falsework in construction.

SUMMARY OF THE INVENTION

The foregoing needs are met, to a great extent, by the present invention, wherein in aspects of this invention, enhancements are provided to the existing models for design of falsework for bridges and general construction.

In an aspect, a falsework hook for use in falsework, scaffolding, and general construction, can include:

a) a tube portion with a tube aperture; and b) a hook portion, connected along a side of the tube portion, such that the hook portion includes an open portion.

In a related aspect, the falsework hook can further include welding joint, which connect the tube portion to the hook portion along a length of the welding joint.

In a related aspect, the tube aperture can be configured to receive a continuous threaded rod, such that the falsework hook is configured to slide along a length of the continuous rod.

In a related aspect, the falsework hook can further include a nut, which is configured to screw onto a continuous threaded rod.

In a related aspect, the falsework hook can further include an eye bolt, such that the eyebolt with a threaded, elongated outer end, such that the tube portion is configured to receive the elongated outer end.

In another aspect, a falsework fastener can include:

a) first and second falsework hooks; and b) a falsework connector, which is configured to connect between the first and second falsework hooks;

such that first falsework hook is configured to receive a first end of the falsework connector and the second falsework hook is configured to receive a second end of the falsework connector;

such that the falsework connector can include one of a rod connector, which can be a continuous threaded rod, which can be straight, curved, or bent; and a cable connector, including threaded eye bolts, connected with a cable.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
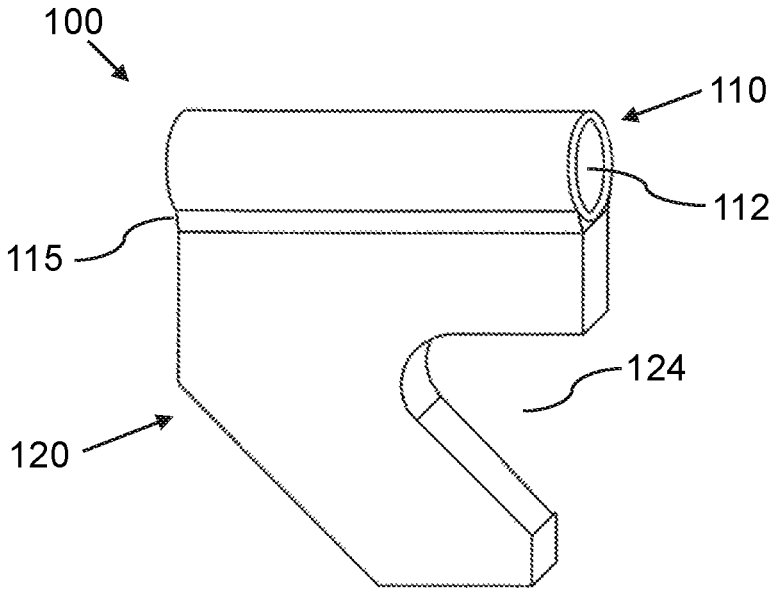
FIG. 1A is a perspective view of a falsework hook, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a falsework hook 100 with reference to FIG. 1, in such manner that like reference numerals refer to like components throughout; a convention that we shall employ for the remainder of this specification.

Figure 1B:
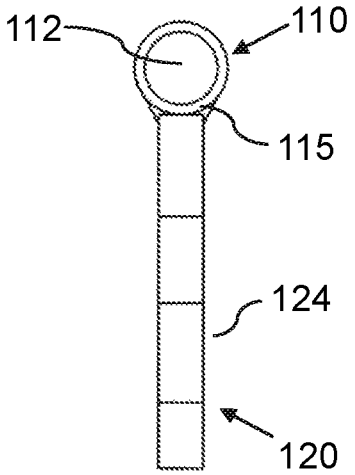
FIG. 1B is a front view of a falsework hook, according to an embodiment of the invention.
Figure 1C:
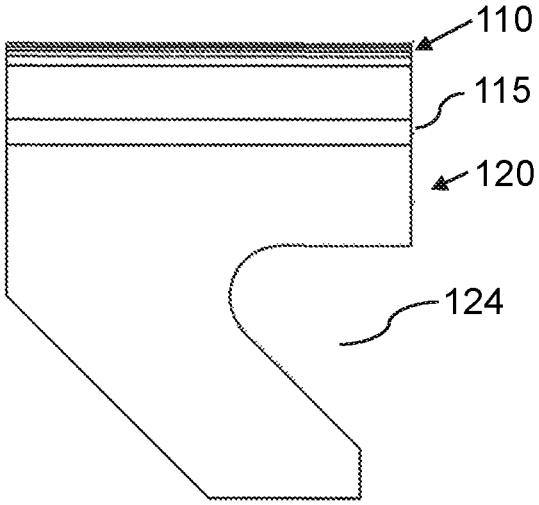
FIG. 1C is a side view of a falsework hook, according to an embodiment of the invention.
Figure 2:
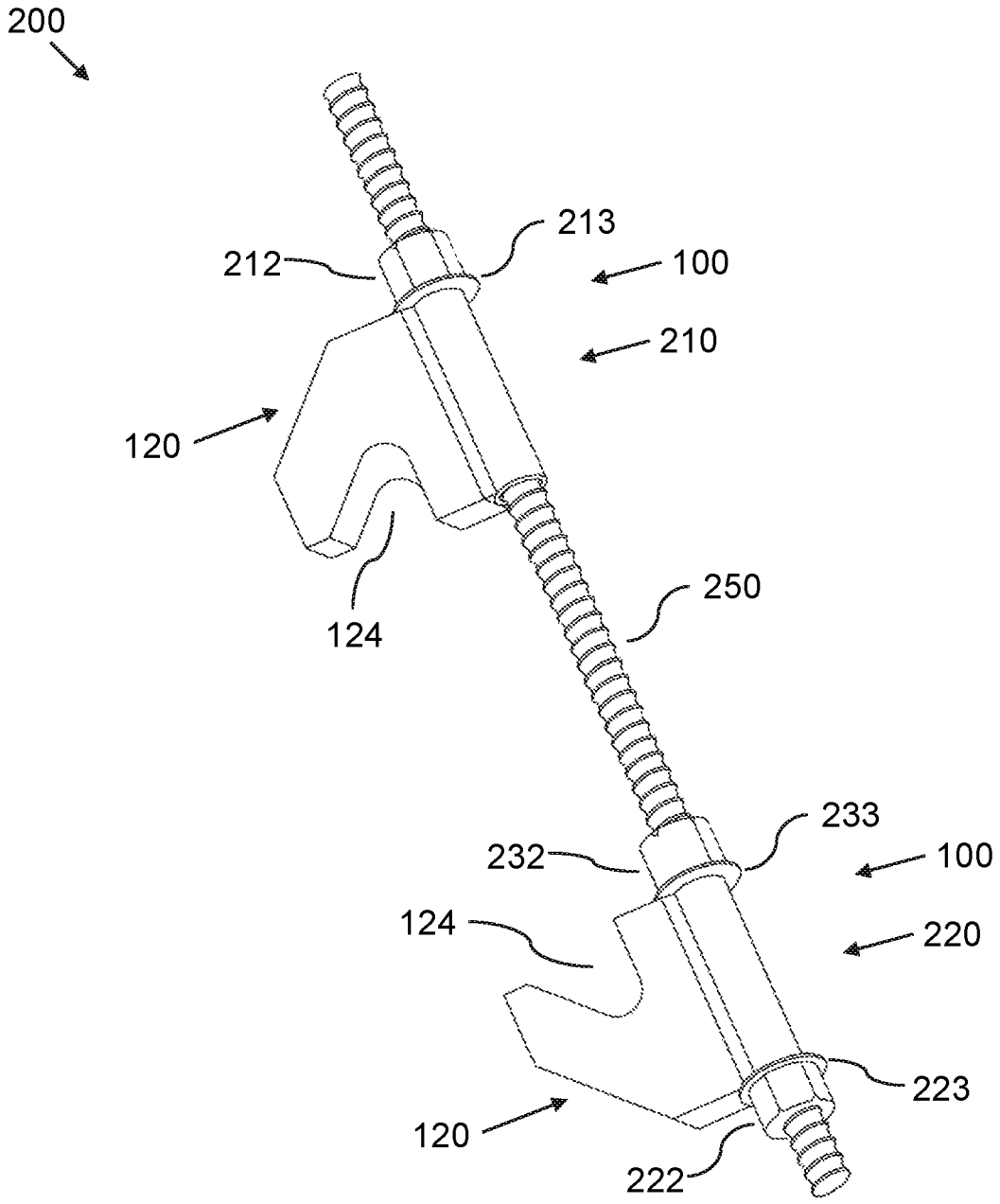
FIG. 2 is a perspective view of a falsework fastener, according to an embodiment of the invention.

In an embodiment, as shown in FIGS. 1A, 1B, and 1C, a falsework hook 100 can include:

a) A holder portion 110, which further comprises a holder aperture 112; and b) A hook portion 120, such that an upper part of the hook portion 120 is connected along a side of the holder portion 110, for example with a welding joint 115, such that the hook portion 120 comprises an indentation or open portion 124, which is configured to exert a force in a direction parallel to the holder aperture 112;

wherein the holder aperture 112 is configured to receive a continuous threaded rod 250, such as shown in FIG. 2.

In a related embodiment, as shown in FIGS. 1A, 1B, and 1C, the holder portion 110 can be a tube portion 110, which is a hollow tube, and the holder aperture 112 can be a tube aperture 112. In other related embodiments, the holder portion 110 can be a rectangular piece, or other type of piece, which can be elongated along a length of the holder aperture 112. Henceforth, any reference to embodiments with a tube portion 110 and a tube aperture 110, should be understood to also include embodiments wherein the tube portion 110 is a holder portion 110, that may not be shaped as a hollow tube.

In a related embodiment, the falsework hook 100 can be made of a high-strength metal, such as stainless steel, wherein the tube portion 110 and the hook portion 120 are welded together in a welding joint 115.

In various related embodiments, the falsework hook 100 can be used with other common construction materials to serve several functions required during cast-in-place concrete bridge construction.

In a related embodiment, the falsework hook 100 can be fabricated with a ½ inch thick steel bar, four inches by five inches, and a ¾ inch diameter steel pipe. The steel pipe can be welded to the steel bar with the ends of the steel pipe flush with the ends of the steel bar. The fabrication of the hook may vary. Casting, rolling or other means of fabricating the shape may prove more cost effective. Size of materials may vary according to application.

In various embodiments, the falsework hook 100 provides a method of resisting horizontal falsework loading, in a manner that is more efficient than the methods currently employed. As shown in more detail below, the falsework hook 100 is versatile and easy to install. It can for example simplify the several necessary falsework attachments that are commonly required in bridge falsework construction. All of the falsework or scaffolding bracing can be installed by a single worker, while traditional methods often require at least two workers.

In an embodiment, as shown in FIG. 2, a straight falsework fastener 200 can include:

a. A first falsework hook 210;

b. A first outer nut 212;

c. A first outer washer 213;

d. A second falsework hook 220;

e. A second outer nut 222;

f. A second outer washer 223;

g. A continuous threaded rod 250;

Wherein the continuous threaded rod 250 is configured to be passed through each of the falsework hooks 210 220, such that the hook portions of the falsework hooks 210 220 are configured to be oppositely positioned, such that open portions 124 of the hook portions 120 are facing toward each other.

In a related embodiment, the straight falsework fastener 200 can further comprise an inner nut 232 and inner washer 233, such that one of the falsework hooks 210 220 can be restrained from rotation by securing it between two nuts and washers, to facilitate ease of installation. As shown in FIG. 2, the second falsework hook 220, can be secured between the second outer nut 222 and outer washer 223, and the inner nut 232 and washer 233.

Figure 3A:
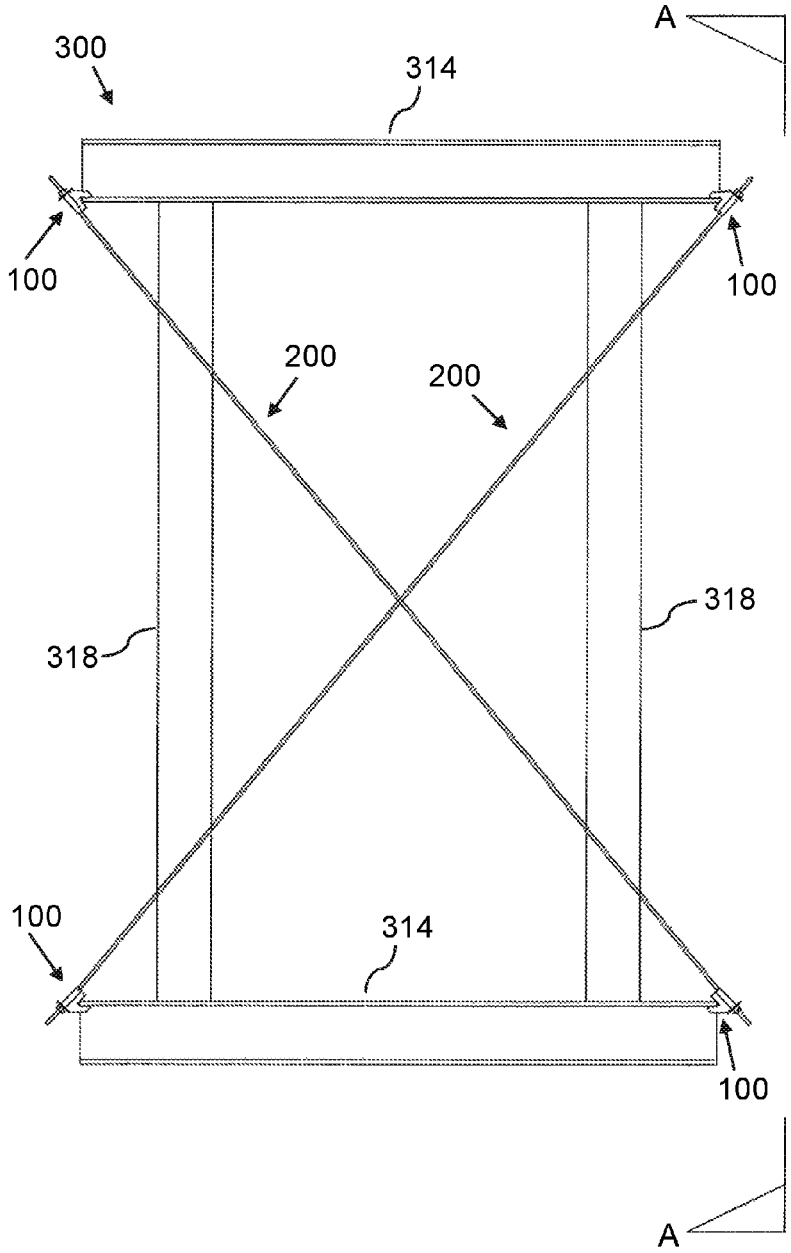
FIG. 3A is a front elevation view of a falsework fastener assembly that is providing lateral bracing, according to an embodiment of the invention.

In a related embodiment, as shown in FIGS. 3A (Elevation) and 3B (Section), the straight falsework fastener 200 can be used to provide lateral bracing in a "falsework bent".

Falsework bents consist of posts 318, shown here as 12"×12" timber, and horizontal steel beams 314 on top and bottom of the posts. The diagonal bracing supplied by the Falsework Hooks 100 and the threaded rods 250 provides internal stability to the falsework bent 300, without requiring costlier methods of attachment.

Current methods of providing internal bracing use timber boards, steel cables or steel bars, wherein:

a. The timber is attached by drilling holes through the board and timber post. This requires a substantial drill and is very time consuming. Nails are also used for timber connections. Numerous nails are required for each board. The driving of the nails is time consuming and exhausts the carpenters who drive them.

b. Steel cable is attached with cable clips, cable thimbles and a shackle. To tighten the cable, special tools are required. Installing and tightening the cable is time consuming.

c. Steel bars are often used for internal bracing when steel pipe is used for posts. The connections require welding channel steel to the pipe, then welding the steel bar to the channel. The process requires qualified welders and welding equipment. Both welders and their equipment are expensive.

In a related embodiment, a falsework hook 100 and/or a straight falsework fastener 200 can be installed by a single carpenter with a wrench, much faster and more economical than conventional methods using timber, steel cable or rods.

Figure 4A:
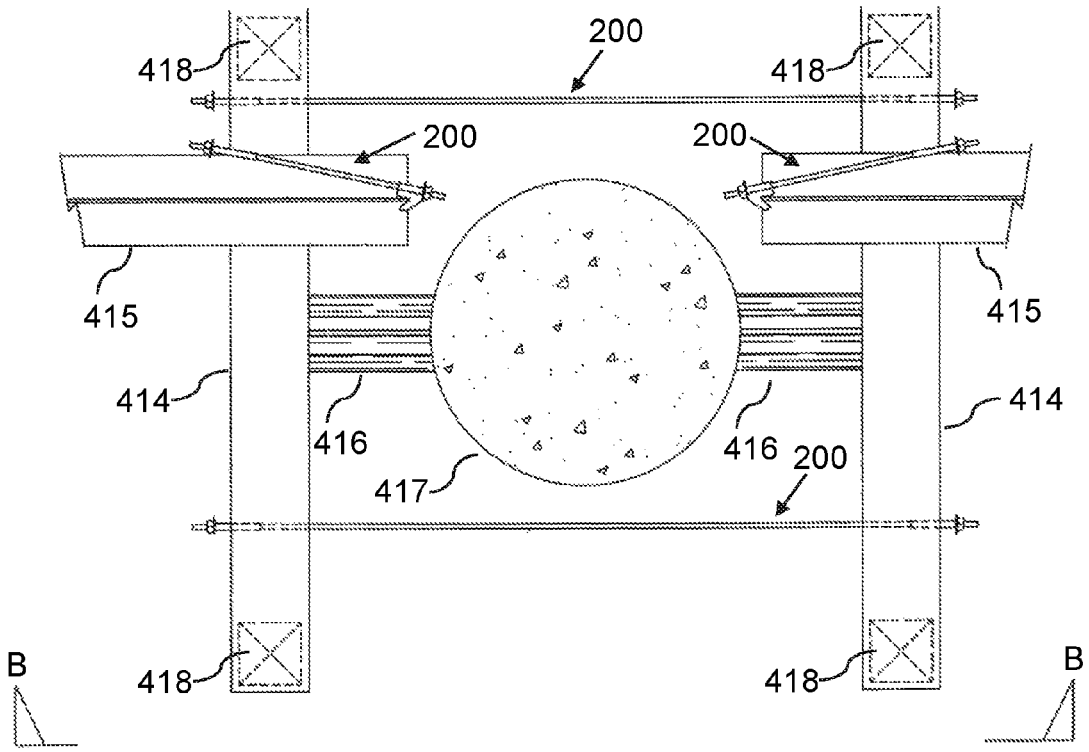
FIG. 4A is a plan view of a falsework fastener assembly configured for bridge falsework, according to an embodiment of the invention.

In a related embodiment, FIGS. 4A (Plan) and 4B (Elevation) show the straight falsework fastener 200 serving two functions:

a. securing cap beams 414 to a concrete bridge pier 417 by using a timber block 416, with straight falsework fasteners 200 mounted between the cap beams 414; and b. restraining a falsework stringer 415 from moving towards the concrete pier 417. A similar arrangement at the opposite ends of the falsework stringer 415, restrains the stringers from moving in the opposite direction.

Current methods of securing falsework cap beams to concrete bridge piers utilize steel cable, steel banding or continuous threaded rods. The use of steel cable again requires cable clips and tightening tools to install. Softeners on the corners of the cap beams are necessary as well. Steel banding requires special tools and fasteners. Softeners for the cap beam are also necessary. Both the steel cable and banding require two men or one man moving to multiple locations. The continuous threaded rod method utilizes lumber to fabricate the connection.

The Falsework Fastener method can be installed from one side of the falsework stringer, making it easier to install than with earlier tools, devices, and methods. Past conventional methods of restraining the falsework stringer across the cap beam utilize a piece of angle steel and two C-Clamps. The installation of the two C-Clamps requires the installer to move from one side of the falsework stringer to the other.

Figure 5A:
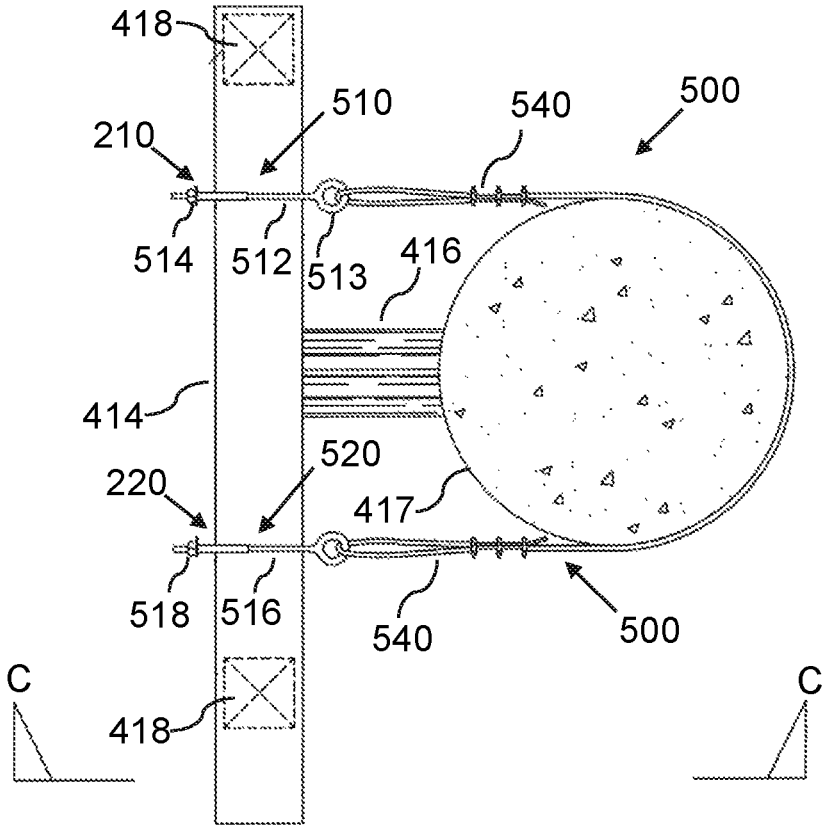
FIG. 5A is a plan view of a falsework fastener assembly, wherein the falsework fasteners are configured with eyebolts, according to an embodiment of the invention.
Figure 5B:
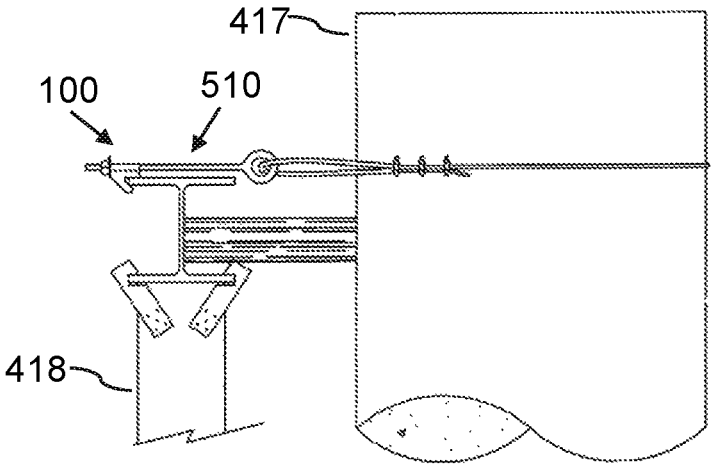
FIG. 5B is a section view of the falsework fastener assembly shown in FIG. 5A, taken along line C-C.

In a related embodiment, as shown in FIGS. 5A and 5B, an eyed falsework hook 510, can include:

a. a falsework hook 100;

b. an eye bolt 512, with an eye 513 on an inner end of the eye bolt 512, and threading on an outer end, such that an elongated part of the eye bolt with the threading is configured to be inserted through the falsework hook 100;

c. a nut/washer 514, which is configured to screw on to the threaded outer end of the eye bolt 512, such that the eyebolt 512 is configured to be securely connected to the falsework hook 100.

such that an outer end of the eyebolt is inserted through the tube aperture 112 from an inner side of the falsework hook 100.

In a related embodiment, FIGS. 5A (Plan) and 5B (Elevation) show the eyed falsework hook 510 in use, wherein a first eyed falsework hook 510 is connected to a second eyed falsework hook 520 via a cable 540, which can be made from steel. In this arrangement, the falsework hook 100, secures a cap beam 414, which is supported by timber posts 418, to concrete bridge pier 417 with the use of timber block 416.

In a related embodiment, as shown in FIGS. 5A and 5B, a flexible falsework fastener 500 can include:

a. a first eyed falsework hook 510, having a first eye;

b. a second eyed falsework hook 520, having a second eye;

c. a cable, which connects the first and second eyed falsework hooks 510 520, such that a first end of the cable is connected to the first eye and a second end is connected to the second eye.

Alternatively, the embodiment shown in FIGS. 5A and 5B, can be described such that a flexible falsework fastener 500 can include:

a. a first falsework hook 210;

b. a second falsework hook 220;

c. a cable connector, comprising:

i. a first eye bolt 512, with an eye 513 on an inner end of the first eye bolt 512, and threading on a first outer end, such that an elongated part of the first eye bolt with the threading is configured to be inserted through the first tube aperture of the first falsework hook 100;

ii. a second eye bolt 516, with an eye on an inner end of the second eye bolt 516, and threading on a second outer end, such that an elongated part of the second eye bolt 516 with the threading is configured to be inserted through the second tube aperture of the second falsework hook 220;

iii. a cable 540, which connects the first and second eye bolts 516, such that a first end of the cable is connected to the first eye and a second end is connected to the second eye.

d. a first nut 514, which is configured to screw on to the threaded first outer end of the first eye bolt 512, such that the first eyebolt 512 is configured to be securely connected to the first falsework hook 210;

e. a second nut 518, which is configured to screw on to the threaded second outer end of the second eye bolt 516, such that the second eyebolt 516 is configured to be securely connected to the second falsework hook 210.

Figure 4B:
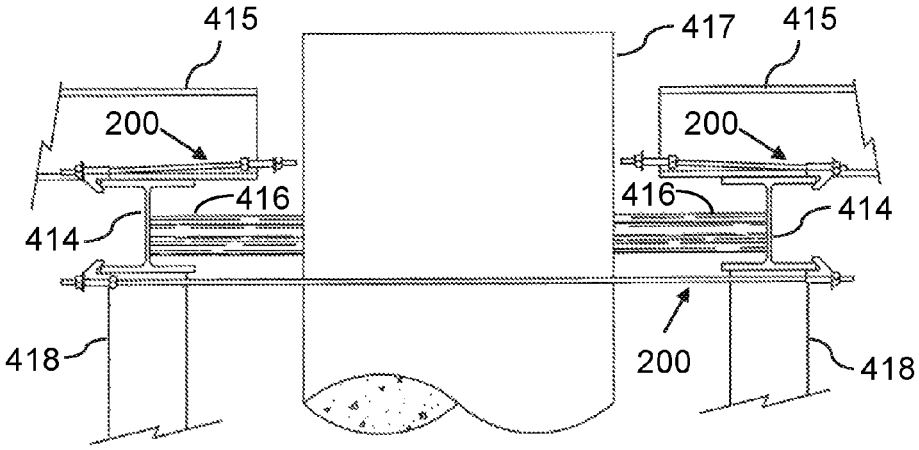
FIG. 4B is a section view of the falsework fastener assembly shown in FIG. 4A, taken along line B-B, according to an embodiment of the invention.

Thus, FIGS. 5A and 5B illustrate another method to secure a cap beam 414, which is supported by timber posts 418, to concrete bridge pier 417 with the use of timber block 416, as compared to the methods shown in FIGS. 4A and 4B, thereby illustrating the versatility of the falsework hook 100, which can be used in configurations as straight and/or flexible falsework fastener 200 500, and in many other configurations, with one, two, or a plurality of falsework hooks 100 510.

Figure 9A:
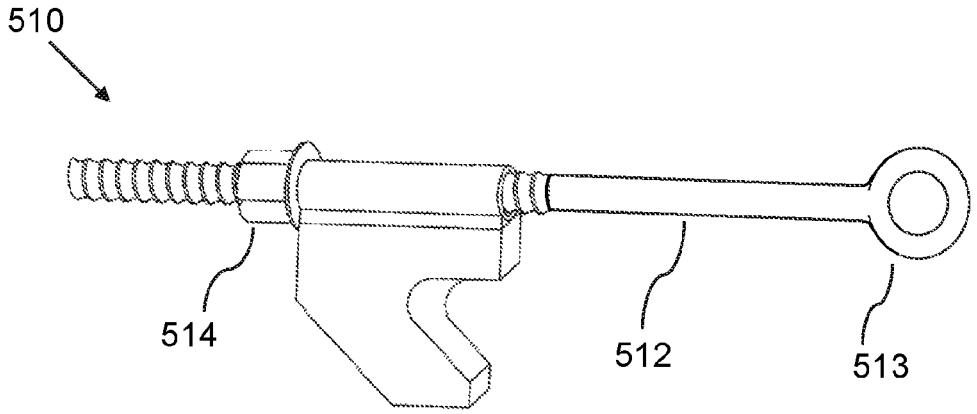
FIG. 9A is a perspective view of an eyed falsework hook, according to an embodiment of the invention.

In a related embodiment, FIG. 9A shows an eyed falsework hook 510.

Figure 9B:
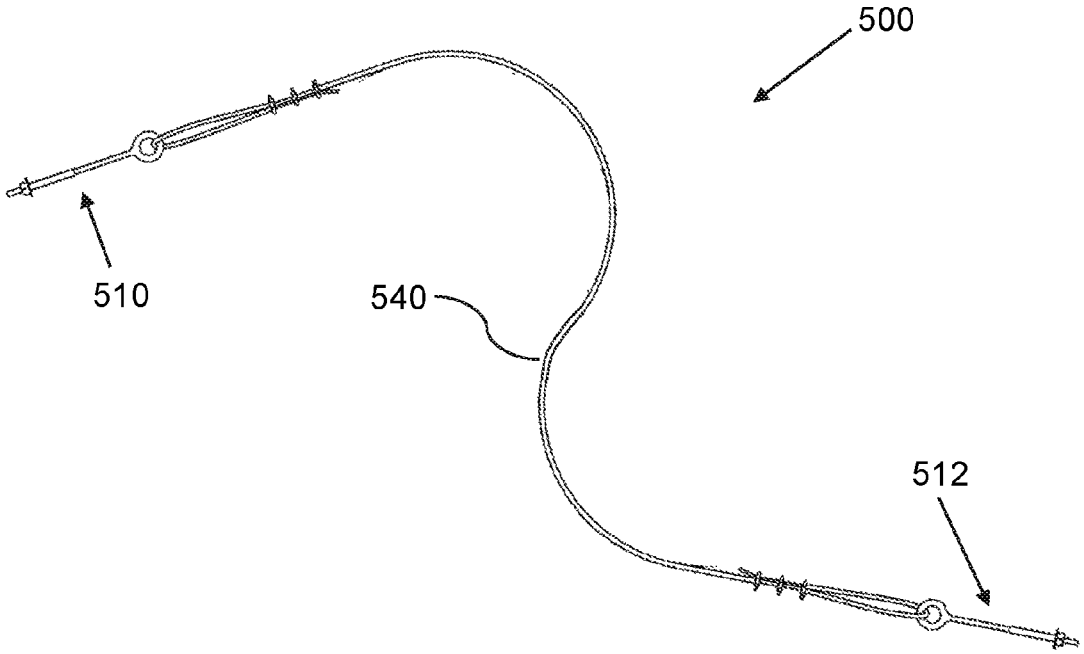
FIG. 9B is a perspective view of a flexible falsework fastener, according to an embodiment of the invention.

In a related embodiment, FIG. 9B shows a flexible falsework fastener 500.

Figure 6A:
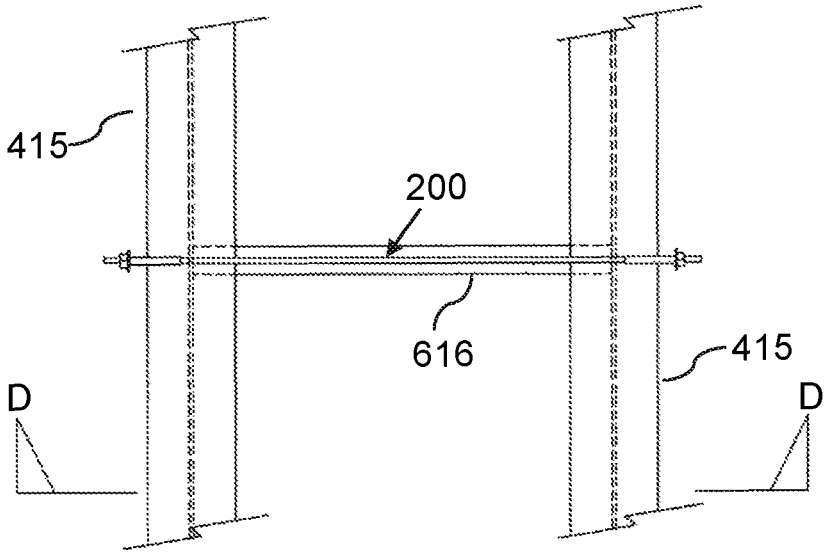
FIG. 6A is a plan view of a falsework fastener assembly configured to brace two falsework stringers, according to an embodiment of the invention.

In a related embodiment, FIGS. 6A (plan view) and 6B (section view) shows the straight falsework fastener 200 used in conjunction with wooden blocking 616 to brace two falsework stringers 415, for lateral stability. This prevents compression flange failure in the stringers.

Figure 6B:
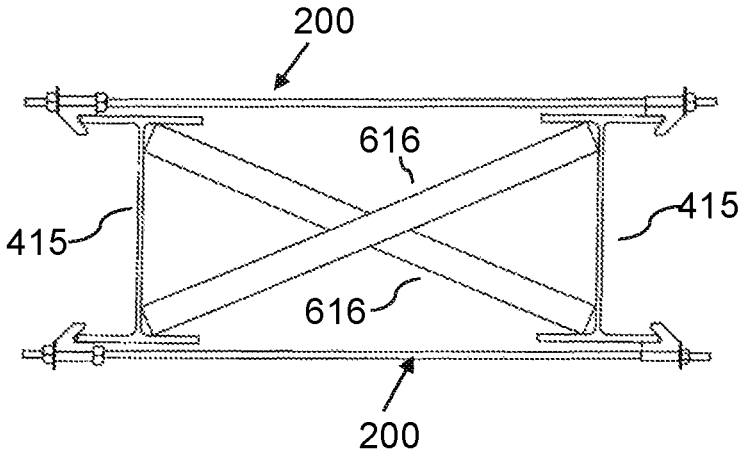
FIG. 6B is a section view of the falsework fastener assembly shown in FIG. 6A, taken along line D-D.

The embodiment shown in FIGS. 6A and 6B can be installed with a wrench. In comparison, a past well-known method utilizes steel banding with the wooden blocks. The banding needs softeners on the stringers to prevent crimping. The tightening of the banding requires a special tool and training in its use.

Figure 7A:
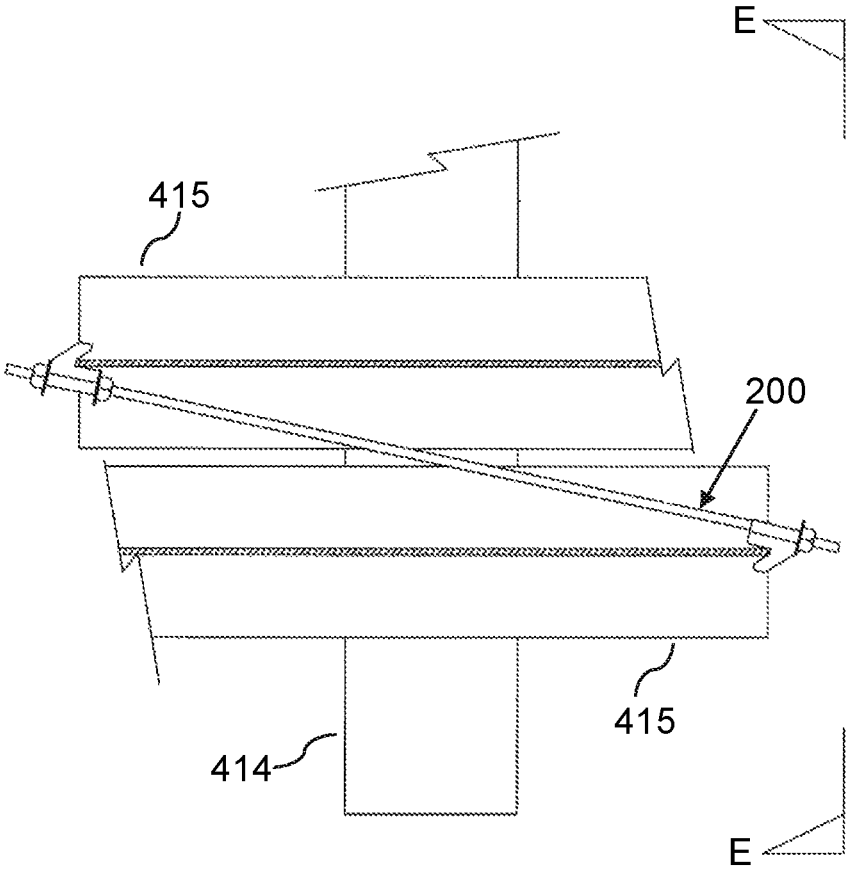
FIG. 7A is a plan view of a falsework fastener configured to secure two falsework stringers in a tension only connection, according to an embodiment of the invention.

In another related embodiment, FIGS. 7A (plan view) and 7B (section view) show the straight falsework fastener 200 used to secure two stringers 415 together in a tension only connection. This allows the longitudinal loading to be transferred across the falsework bent.

The method currently used to transfer the loading in this manner is with a pair of the C-Clamps and angle steel on each stringer. This is similar to the second connection shown in FIGS. 4A and 4B.

Figure 3B:
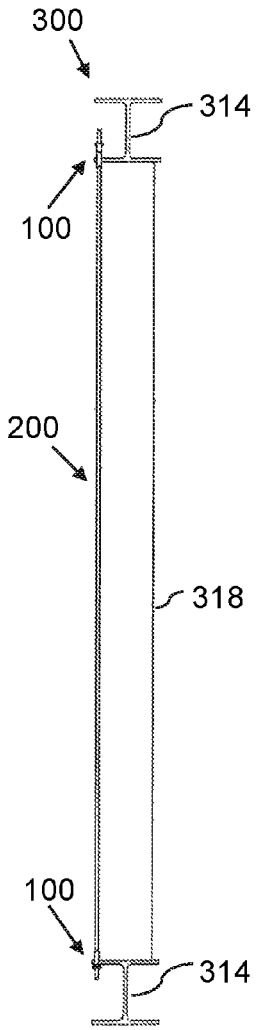
FIG. 3B is a sectional view of the falsework fastener assembly shown in FIG. 3A, taken along line A-A, according to an embodiment of the invention.
Figure 7B:
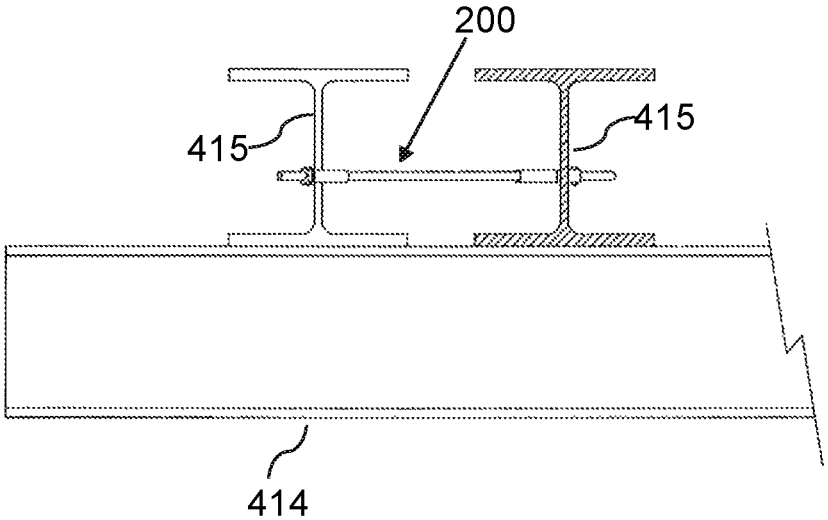
FIG. 7B is a section view of the falsework fastener assembly shown in FIG. 7A, taken along line E-E.
Figure 8:
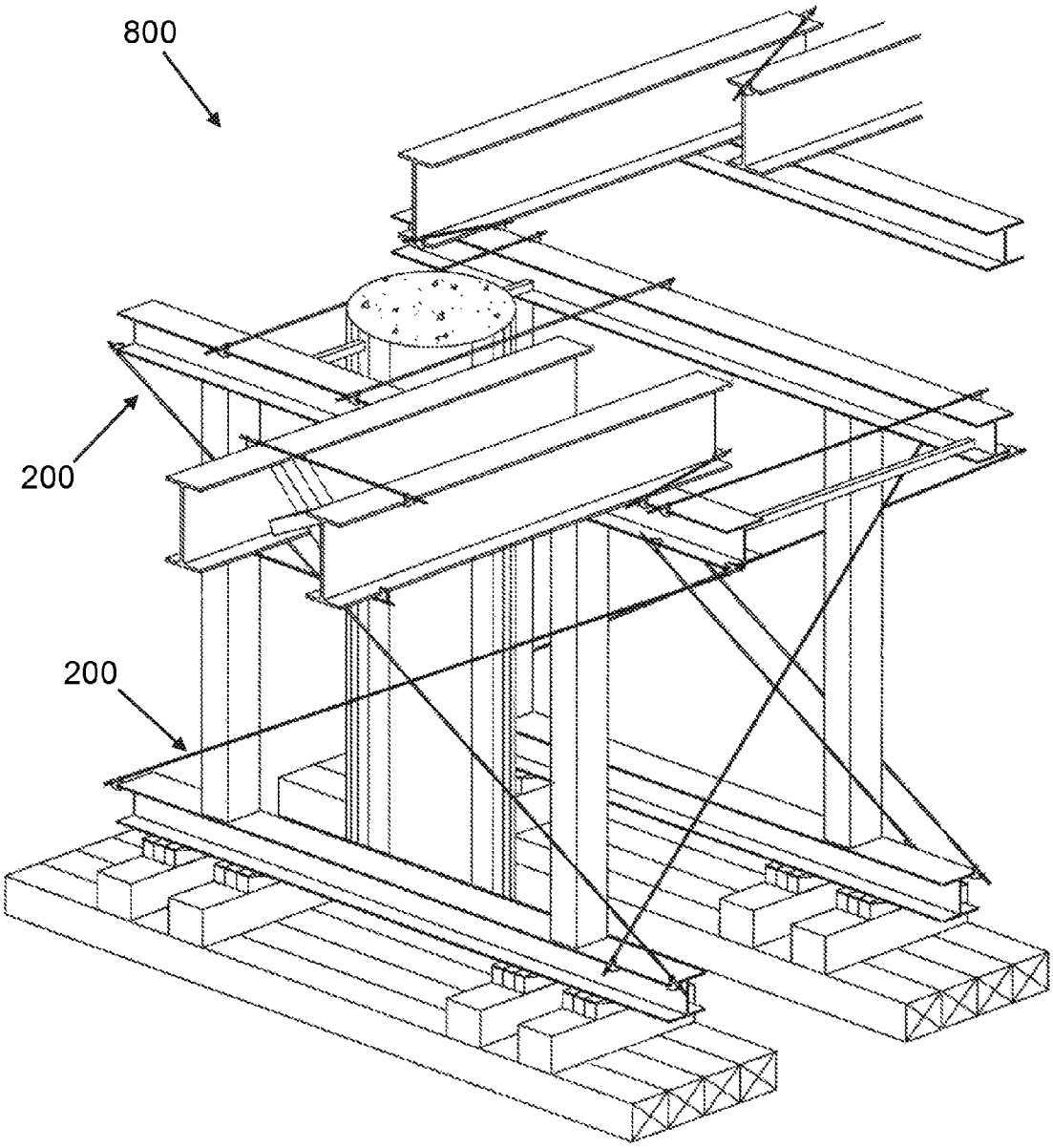
FIG. 8 is a perspective view of a falsework fastener assembly for a concrete column, according to an embodiment of the invention.

In a yet another related embodiment, FIG. 8 shows typical falsework bents at a concrete column, in a falsework configuration 800 using a plurality of straight falsework fasteners 200. The bents are braced transversely and longitudinally as shown in FIG. 3. Further, the bents are secured to the column and the stringers to the falsework cap, as shown in FIG. 4. Additionally, the stringers are braced together as shown in FIG. 6. Finally, the stringers are braced together longitudinally, as shown in FIG. 7. All of these are required bracing which the falsework hook 100, configured as a straight falsework fastener 200, facilitates more economically than past methods of bracing.

Here has thus been described a multitude of embodiments of the falsework hook 100, the eyed falsework hook 510, falsework fasteners 200 500, and various methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A falsework fastener system for use in falsework construction, comprising:

a) a first falsework beam;

b) a second falsework beam; and c) a falsework fastener, comprising:

a first falsework hook, comprising:

a first holder portion, which further comprises a first holder aperture; and a first hook portion, such that an upper part of the first hook portion is connected along a side of the first holder portion, such that the first hook portion comprises a first open portion;

a second falsework hook, comprising:

a second holder portion, which further comprises a second holder aperture; and a second hook portion, such that an upper part of the second hook portion is connected along a side of the second holder portion, such that the second hook portion comprises a second open portion; and d) a falsework connector, which is configured to connect between the first and second falsework hooks;

wherein the first holder aperture is configured to receive a first end of the falsework connector and the second holder aperture is configured to receive a second end of the falsework connector;

wherein the first and second falsework hooks are oppositely mounted to the falsework connector; and wherein the first falsework hook is attached to the first falsework beam and the second falsework hook is attached to the second falsework beam, whereby the falsework fastener provides lateral bracing of the first and second falsework beams.

2. The falsework fastener system of claim 1, wherein the first holder portion is a first tube portion, which is a hollow tube; the first holder aperture is a first tube aperture; the second holder portion is a second tube portion, which is a hollow tube; and the second holder aperture is a second tube aperture.

3. The falsework fastener system of claim 1, further comprising first and second nuts, wherein the first and second ends of the falsework connector are threaded, such that the first and second nuts are configured to screw onto respectively the first and second ends of the falsework connector.

4. The falsework fastener system of claim 3, wherein the falsework connector is connected between the first and second falsework hooks, such that the first and second ends of the falsework connector protrude through respectively the first and second holder apertures, such that the first and second nuts are screwed onto respectively the first and second ends of the falsework connector.

5. The falsework fastener system of claim 1, wherein the falsework connector is a continuous threaded rod.

6. The falsework fastener system of claim 1, wherein the falsework connector is straight, such that the first and second falsework hooks are opposedly mounted to the falsework connector, such that open portions of hook portions of the first and second falsework hooks are facing toward each other.

7. The falsework fastener system of claim 1, wherein the falsework connector is a cable connector, comprising:

a) a first eye bolt, comprising a first eye, and a first elongated part, such that an inner end of the first elongated part is connected to the first eye, and such that an outer end of the first elongated part is threaded, such that the first elongated part is configured to be insertable through the first holder aperture of the first falsework hook;

b) a second eye bolt, comprising a second eye, and a second elongated part, such that an inner end of the second elongated part is connected to the second eye, and such that an outer end of the second elongated part is threaded, such that the second elongated part is configured to be insertable through the second holder aperture of the second falsework hook; and c) a cable, which connects the first and second eye bolts, such that a first end of the cable is connected to the first eye and a second end is connected to the second eye.

8. The falsework fastener system of claim 7, further comprising first and second nuts, such that the first and second nuts are configured to screw onto respectively the first and second threaded ends of the cable connector.

9. The falsework fastener system of claim 8, wherein the cable connector is connected between the first and second falsework hook, such that the first and second ends of the cable connector protrude through respectively the first and second holder apertures, such that the first and second nuts are screwed onto respectively the first and second ends of the falsework connector.

10. The falsework fastener system of claim 1, further comprising at least one falsework post, which is mounted between the first and second falsework beams.

11. A falsework fastener system for use in falsework construction, comprising:

a) a first falsework beam;

b) a second falsework beam; and c) a falsework fastener, comprising:

a) a first falsework hook, comprising:

a first holder portion, which further comprises a first holder aperture; and a first hook portion, such that an upper part of the first hook portion is connected along a side of the first holder portion, such that the first hook portion comprises a first open portion;

b) a second falsework hook, comprising:

a first holder portion, which further comprises a first holder aperture; and a first hook portion, such that an upper part of the first hook portion is connected along a side of the first holder portion, such that the first hook portion comprises a first open portion; and d) a rod connector, which is a continuous threaded rod, which is configured to connect between the first and second falsework hooks;

wherein the first holder aperture is configured to receive a first end of the falsework connector and the second holder aperture is configured to receive a second end of the falsework connector;

wherein the first and second falsework hooks are oppositely mounted to the falsework connector; and wherein the first falsework hook is attached to the first falsework beam and the second falsework hook is attached to the second falsework beam, whereby the falsework fastener provides lateral bracing of the first and second falsework beams.

12. The falsework fastener system of claim 11, wherein the first holder portion is a first tube portion, which is a hollow tube; the first holder aperture is a first tube aperture; the second holder portion is a second tube portion, which is a hollow tube; and the second holder aperture is a second tube aperture.

13. The falsework fastener system of claim 11, further comprising first and second nuts, such that the first and second nuts are configured to screw onto respectively first and second ends of the rod connector.

14. The falsework fastener system of claim 13, wherein the falsework connector is connected between the first and second falsework hook, such that the first and second ends of the falsework connector protrude through respectively the first and second holder apertures, such that the first and second nuts are screwed onto respectively the first and second ends of the continuous threaded rod.

15. The falsework fastener system of claim 11, wherein the rod connector is straight, such that the first and second falsework hooks are opposedly mounted to the falsework connector, such that open portions of hook portions of the first and second falsework hooks are facing toward each other.

16. The falsework fastener system of claim 11, further comprising at least one falsework post, which is mounted between the first and second falsework beams.

* * * * *